US009784066B1

(12) United States Patent
Branton

(10) Patent No.: US 9,784,066 B1
(45) Date of Patent: Oct. 10, 2017

(54) DOWNHOLE BRIDGE PLUG OR PACKER ASSEMBLIES

(71) Applicant: Christopher A. Branton, Benton, LA (US)

(72) Inventor: Christopher A. Branton, Benton, LA (US)

( * ) Notice: Subject to any disclaimer, the term of this patent is extended or adjusted under 35 U.S.C. 154(b) by 343 days.

(21) Appl. No.: 14/794,890

(22) Filed: Jul. 9, 2015

(51) Int. Cl.
*E21B 33/12* (2006.01)
*E21B 33/128* (2006.01)

(52) U.S. Cl.
CPC ..... *E21B 33/1216* (2013.01); *E21B 33/128* (2013.01)

(58) Field of Classification Search
CPC ..... E21B 33/128; E21B 33/134; E21B 33/12; E21B 33/1216
USPC ..... 166/196
See application file for complete search history.

(56) References Cited

U.S. PATENT DOCUMENTS 4,491,178 A 1/1985 Terrell et al.
7,290,603 B2 11/2007 Hiorth et al.
7,424,909 B2 9/2008 Roberts et al.
7,762,323 B2 7/2010 Frazier
7,980,300 B2 7/2011 Roberts et al.
8,016,295 B2 9/2011 Guest et al.
8,205,671 B1 6/2012 Branton
9,260,936 B1 * 2/2016 Branton ..... E21B 33/1216
2009/0126925 A1 5/2009 Guest et al.
2013/0146277 A1 * 6/2013 Bishop ..... E21B 33/1216 166/118

* cited by examiner

*Primary Examiner* — Michael Wills, III
(74) *Attorney, Agent, or Firm* — R. Keith Harrison

(57) ABSTRACT

Bridge plug or packer assemblies include a mandrel, at least one sealing element provided on the mandrel and a pair of backup rings provided on the mandrel on respective sides of the at least one sealing element. Each of the pair of backup rings including an annular backup ring body having a ring opening receiving the mandrel, a ring opening edge encircling and facing the ring opening, an engaging ring surface, an outer ring surface extending from the engaging ring surface to the ring opening edge, an inner ring surface extending from the engaging ring surface to the ring opening edge opposite the outer ring surface and a single spiraled ring groove in the backup ring body. A mandrel cap may be provided on the mandrel in engaging relationship to a second one of the pair of backup rings. A first shear-able ring retainer pin may couple the backup ring body of the first one of the pair of backup rings to the gauge ring. A second shear-able ring retainer pin may couple the backup ring body of the second one of the pair of backup rings to the mandrel cap.

20 Claims, 13 Drawing Sheets

DOWNHOLE BRIDGE PLUG OR PACKER ASSEMBLIES

CROSS-REFERENCE TO RELATED APPLICATIONS

This application is related to co-pending U.S. application Ser. No. 13/468,158, filed May 10, 2012 and entitled "DOWNHOLE BRIDGE PLUG OR PACKER ASSEMBLIES".

FIELD

Illustrative embodiments of the disclosure generally relate to downhole bridge plugs for plugging a subterranean well. More particularly, the present disclosure relates to downhole bridge plug or packer assemblies having slotted expandable sealing rings which facilitate a substantially complete circumferential seal with a well casing in the plugging of a subterranean well.

SUMMARY

Illustrative embodiments of the disclosure are generally directed to bridge plug or packer assemblies having slotted expandable sealing rings which facilitate a substantially complete circumferential seal with a well casing in the plugging of a subterranean well. An illustrative embodiment of the bridge plug or packer assemblies include a mandrel, at least one sealing element provided on the mandrel and a pair of backup rings provided on the mandrel on respective sides of the at least one sealing element. Each of the pair of backup rings including an annular backup ring body having a ring opening receiving the mandrel, a ring opening edge encircling and facing the ring opening, an engaging ring surface, an outer ring surface extending from the engaging ring surface to the ring opening edge, an inner ring surface extending from the engaging ring surface to the ring opening edge opposite the outer ring surface and a single spiraled ring groove in the backup ring body. A mandrel cap may be provided on the mandrel in engaging relationship to a second one of the pair of backup rings. A first shear-able ring retainer pin may couple the backup ring body of the first one of the pair of backup rings to the gauge ring. A second shear-able ring retainer pin may couple the backup ring body of the second one of the pair of backup rings to the mandrel cap.

In some embodiments, the bridge plug or packer assemblies may include a mandrel; at least one sealing element provided on the mandrel; a pair of backup rings provided on the mandrel on respective sides of the at least one sealing element, each of the pair of backup rings including an outer backup ring portion having an annular outer backup ring portion body; a ring opening in the outer backup ring portion body, the ring opening in the outer backup ring portion body receiving the mandrel; a ring opening edge in the outer backup ring portion body, the ring opening edge encircling and facing the ring opening in the outer backup ring portion body; an engaging ring surface in the outer backup ring portion body; an outer ring surface extending from the engaging ring surface to the ring opening edge in the outer backup ring portion body; an inner ring surface extending from the engaging ring surface to the ring opening edge in the outer backup ring portion body opposite the outer ring surface; and a single spiraled ring groove in the outer backup ring portion body, the spiraled ring groove in the outer backup ring portion body having: a main groove segment in the engaging ring surface in the outer backup ring portion body; an inner surface groove segment extending from the main groove segment along a portion of the inner ring surface of the outer backup ring portion body; and an outer surface groove segment extending from the main groove segment along a portion of the outer ring surface of the outer backup ring portion body; an inner backup ring portion coupled to the outer backup ring portion, the inner backup ring portion having: an annular inner backup ring portion body; a ring opening in the inner backup ring portion body, the ring opening in the inner backup ring portion body receiving the mandrel; an engaging ring surface in the inner backup ring portion body; a ring opening surface in the inner backup ring portion body; an outer ring surface extending from the engaging ring surface to the ring opening surface in the inner backup ring portion body; an inner ring surface extending from the engaging ring surface to the ring opening surface in the inner backup ring portion body opposite the outer ring surface of the inner backup ring portion body; and a single spiraled ring groove in the inner backup ring portion body, the spiraled ring groove in the inner backup ring portion body having a main groove segment in the engaging ring surface of the inner backup ring portion body an inner surface groove segment extending from the main groove segment along a portion of the inner ring surface of the inner backup ring portion body; an outer surface groove segment extending from the main groove segment along a portion of the outer ring surface of the inner backup ring portion body; and an interior groove segment extending from the inner surface groove segment along the ring opening surface of the inner backup ring portion body and to the outer surface groove segment of the inner backup ring portion body; a gauge ring provided on the mandrel and engaging the outer backup ring portion of a first one of the pair of backup rings; a mandrel cap provided on the mandrel and engaging the outer backup ring portion of a second one of the pair of backup rings; a first shear-able ring retainer pin coupling the outer portion backup ring body of the first one of the pair of backup rings to the gauge ring; and a second shear-able ring retainer pin coupling the outer portion backup ring body of the second one of the pair of backup rings to the mandrel cap.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. As used herein, relative terms such as "upper" and "lower" are intended to be used in an illustrative and not a limiting sense. In some applications, therefore, those elements which are identified as "upper" may be located beneath those elements which are identified as "lower" in the following detailed description. Moreover, in some applications, those elements of the assembly which are identified as "upper" and "lower" may be located in horizontal or diagonal relationship to each other.

Figure 1:
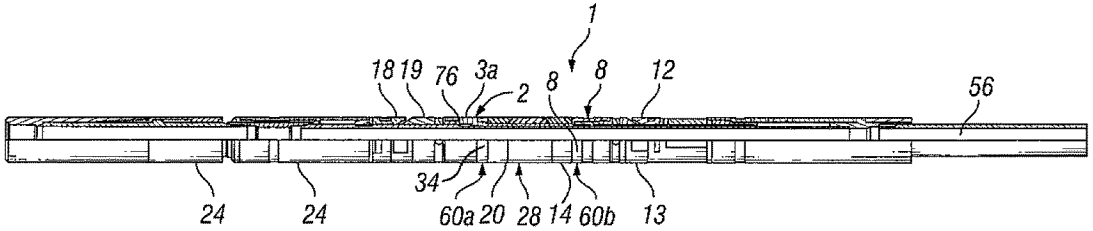
FIG. 1 is a side view of an illustrative embodiment of the downhole bridge plug or packer assemblies deployed in a tubing string, with a hydraulic setting tool engaging the downhole bridge plug or packer assembly in typical application thereof.

Referring initially to FIGS. 1-15 of the drawings, an illustrative embodiment of the drillable downhole bridge plug assembly or packer assemblies, hereinafter assembly, is generally indicated by reference numeral 1. As illustrated in FIG. 1 and will be hereinafter described, the assembly 1 may be deployed on a tubing string 56 in a well casing 52 (FIG. 13) which extends into a subterranean fluid-producing well (not illustrated) such as an oil and/or gas well, for example and without limitation, between two adjacent production fractions in the well. After placement in the well casing 52, the assembly 1 can be deployed from a pre-expanded position to a circumferentially-expanded position to engage the well casing 52 and seal fractions in the well from each other, preventing flow of fluid between the fractions in the well in a variety of well remediation operations. A hydraulic setting tool 24 (FIG. 1) may be provided on the tubing string 56 to facilitate placement and deployment of the assembly 1 in the well casing 52 as is known by those skilled in the art.

Figure 2:
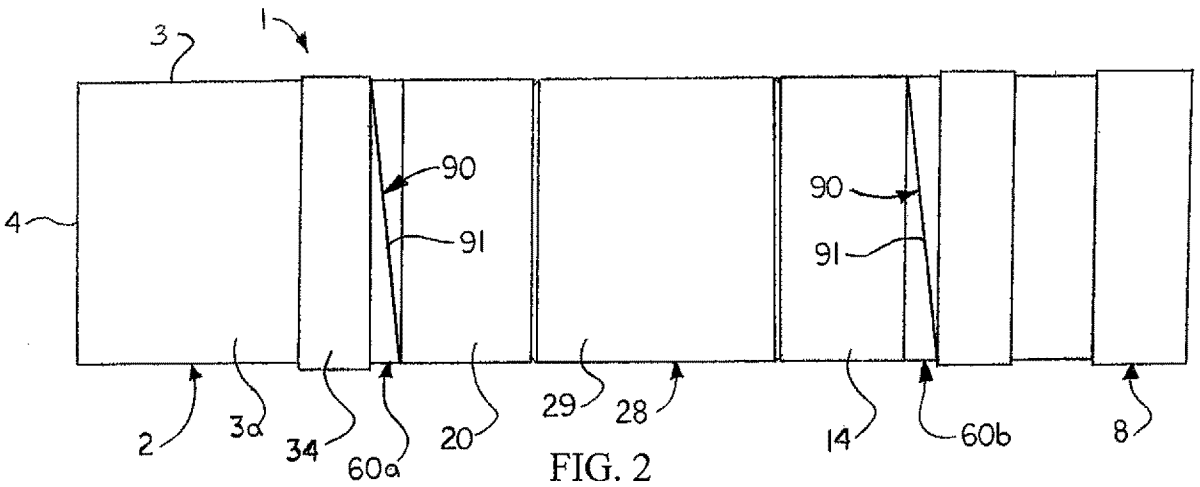
FIG. 2 is a side view of an illustrative embodiment of the downhole bridge plug or packer assemblies.
Figure 3:
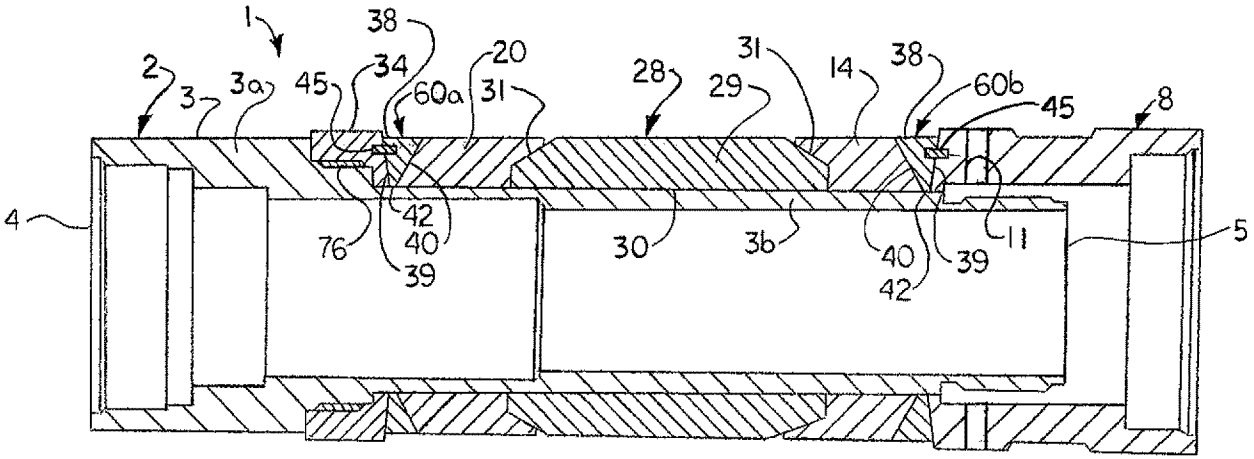
FIG. 3 is a longitudinal sectional view of the illustrative downhole bridge plug or packer assembly illustrated in FIG. 2.
Figure 3A:
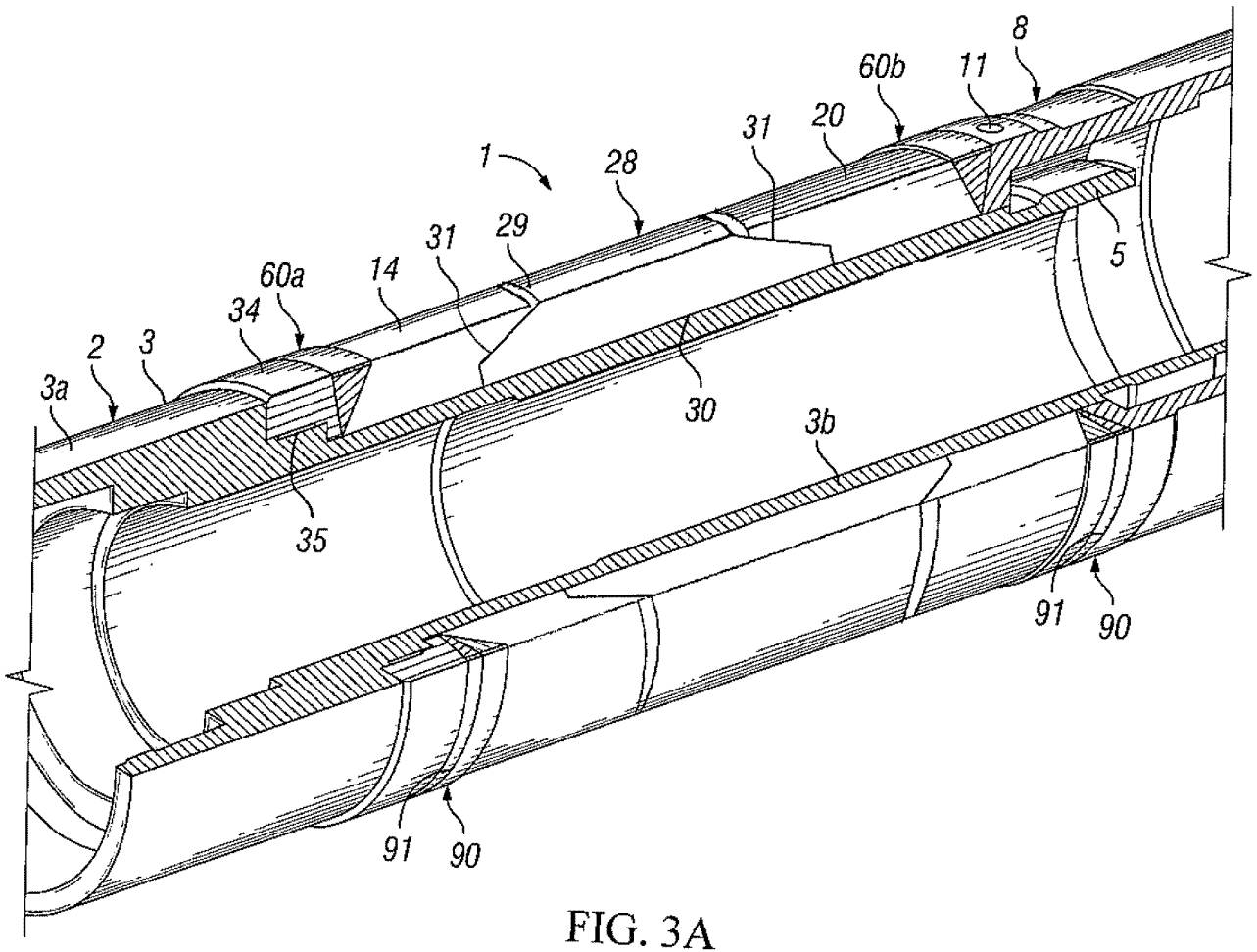
FIG. 3A is a longitudinal sectional perspective view of the illustrative downhole bridge plug or packer assembly.

As illustrated in FIGS. 2, 3 and 3A, the assembly 1 may include a mandrel 2 which may include any suitable type of rigid drillable material including but not limited to metal, composite material and/or engineering-grade plastic. The mandrel 2 may have a generally elongated, cylindrical mandrel wall 3 which forms a mandrel head 3*a* and an elongated mandrel shaft 3*b* extending from the mandrel head 3*a*. The mandrel 2 may have a mandrel upper end 4 which terminates the mandrel head 3*a* and a mandrel lower end 5 which terminates the mandrel shaft 3*b*. A mandrel cap 8 may receive the mandrel lower end 5 of the mandrel 2.

As illustrated in FIG. 1, in typical application of the assembly 1, which will be hereinafter described, an upper pressure-applying element such as an upper cone assembly 19 may engage the mandrel head 3*a* of the mandrel 2 via a threaded or other connection according to the knowledge of those skilled in the art. An upper slip assembly 18 may engage the upper cone assembly 19 typically via ratchet teeth (not illustrated) in the conventional manner. The hydraulic setting tool 24 may be provided on the tubing string 56 above the upper slip assembly 18. A lower cone assembly 13 may engage the mandrel cap 8 via a threaded or other connection according to the knowledge of those skilled in the art. A lower slip assembly 12 may engage the lower cone assembly 13.

The assembly 1 may include an upper backup ring 60*a* and a lower backup ring 60*b* provided on the mandrel 2. The structure of the upper backup ring 60*a* and the lower backup ring 60*b* will be hereinafter described. An annular sealing element 28, which will be hereinafter described, may be provided on the mandrel 2 between the upper backup ring 60*a* and the lower backup ring 60*b*. In some embodiments, an upper spacer ring 20 may be provided on the mandrel shaft 3*b* and sandwiched between the upper backup ring 60*a* and the sealing element 28. A lower spacer ring 14 may be provided on the mandrel shaft 3*b* and sandwiched between the lower backup ring 60*b* and the sealing element 28. A gauge ring 34 may be sandwiched between the mandrel head 3*a* of the mandrel 2 and the upper backup ring 60*a*. The gauge ring 34 may be coupled to the mandrel head 3*a* of the mandrel 2 via gauge ring threads 35.

Figure 8:
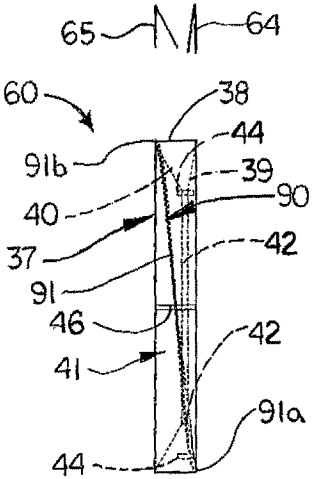
FIG. 8 is a side view of the backup ring.

As illustrated in FIGS. 4-8, each of the upper backup ring 60*a* and the lower backup ring 60*b* (illustrated as backup ring 60) may include an annular backup ring body 37 which may include rubber or other elastomeric material and through which extends a ring opening 41. In some embodiments, the backup ring body 37 may have a continuous unitary or one-piece construction and may include PEEK (polyether ether ketone), for example and without limitation. The backup ring body 37 may have an annular exterior engaging ring surface 38 and an annular ring opening edge 42 which encircles and faces the ring opening 41. A beveled outer ring surface 39 and a beveled inner ring surface 40 may extend or taper from the exterior engaging ring surface 38 to the ring opening edge 42. As illustrated in FIG. 8, the outer ring surface 39 may be oriented at an outer surface taper angle 64 and the inner ring surface 40 may be oriented at an inner surface taper angle 65 with respect to the plane of the backup ring body 37. The outer surface taper angle 64 of the outer ring surface 39 may be less than the inner surface taper angle 65 of the inner ring surface 40. For example and without limitation, in some embodiments, the outer surface taper angle 64 may be about 10 degrees and the inner surface taper angle 65 may be about 30 degrees. As illustrated in FIG. 3, in the assembled assembly 1, the outer ring surface 39 of the upper backup ring 60*a* faces outwardly and is engaged by the gauge ring 34, whereas the outer ring surface 39 of the lower backup ring 60*b* faces outwardly and is engaged by the mandrel cap 8 (FIG. 3). The inner ring surface 40 of the upper backup ring 60*a* faces inwardly and engages the upper sealing element 20, and the inner ring surface 40 of the lower backup ring 60*b* faces inwardly and engages the lower sealing element 14.

Figure 5:
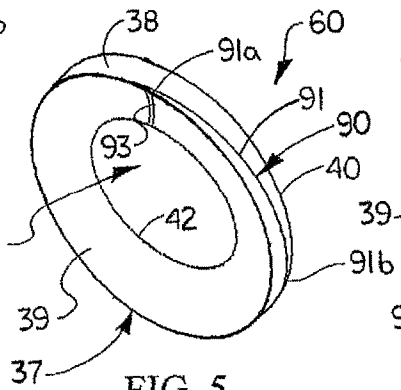
FIG. 5 is an outer perspective view of the backup ring illustrated in FIG. 4.
Figure 4:
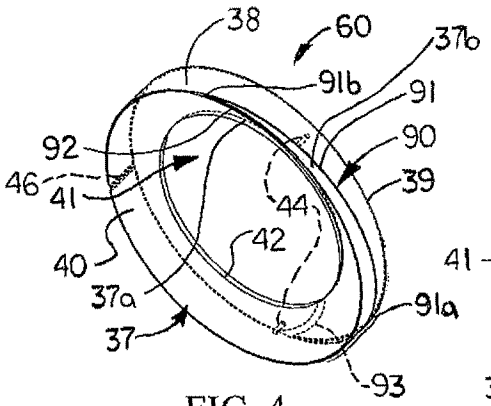
FIG. 4 is an inner perspective view of a typical backup ring of an illustrative embodiment of the downhole bridge plug or packer assemblies.

As illustrated in FIGS. 4-8, a single spiraled ring groove 90 is provided in the backup ring body 37 of each backup ring 60. As illustrated in FIG. 7A, the depth of the spiraled ring groove 90 may extend from the engaging ring surface 38 through the backup ring body 37 to the inner ring surface 40. As illustrated in FIGS. 4 and 5, the spiraled ring groove 90 may include an elongated main groove segment 91 which may be generally straight or axial and extends along a portion of the circumference of the engaging ring surface 38; a generally curved inner surface groove segment 92 (FIGS. 4 and 7) which extends from the main groove segment 91 along a portion of the inner ring surface 40; and a generally curved or straight outer surface groove segment 93 (FIGS. 5-7) which extends from the main groove segment 91 along a portion of the outer ring surface 39. The main groove segment 91 may have an outer main groove segment end 91*a* at the outer ring surface 39 and an inner main groove segment end 91*b* at the inner ring surface 40. From the outer main groove segment end 91*a* to the inner main groove segment end 91*b*, the main groove segment 91 may traverse about 180 degrees of the circumference of the engaging ring surface 38.

The inner surface groove segment 92 of the spiraled ring groove 90 may extend lengthwise from the engaging ring surface 38 to the ring opening edge 42. As particularly illustrated in FIG. 7, the inner surface groove segment 92 may be generally tangential with respect to both the engaging ring surface 38 and with respect to the ring opening edge 42. As illustrated in FIG. 4, at the engaging ring surface 38, the inner surface groove segment 92 may communicate with the inner main groove segment end 91*b* of the main groove segment 91.

Figure 6:
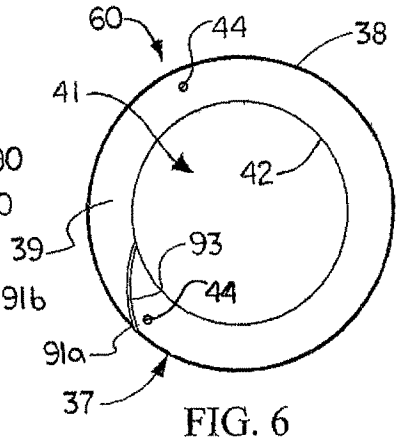
FIG. 6 is an outer view of the backup ring.
Figure 7A:
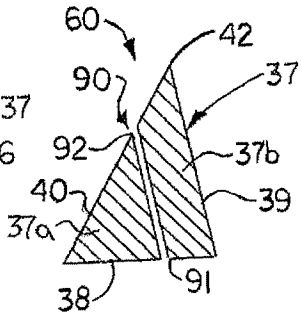
FIG. 7A is a cross-sectional view, taken along section lines 7A-7A in FIG. 7.
Figure 7:
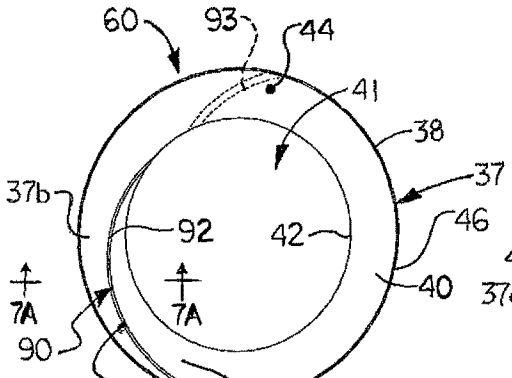
FIG. 7 is an inner view of the backup ring.

As illustrated in FIGS. 5 and 6, the outer surface groove segment 93 of the spiraled ring groove 90 may extend lengthwise from the engaging ring surface 38 to the ring opening edge 42. As illustrated in FIG. 5, at the engaging ring surface 38, the outer surface groove segment 93 may communicate with the outer main groove segment end 91*a* of the main groove segment 91. As illustrated in FIGS. 4 and 7, the spiraled ring groove 90 divides a portion of the backup ring body 37 into an inner ring portion 37*a* and an expandable outer ring portion 37*b*. Accordingly, application of outwardly-directed pressure to the backup ring body 37 facilitates uniform outward circumferential expansion of the expandable outer ring portion 37*b* from the inner ring portion 37*a*, for purposes which will be hereinafter described.

Figure 12:
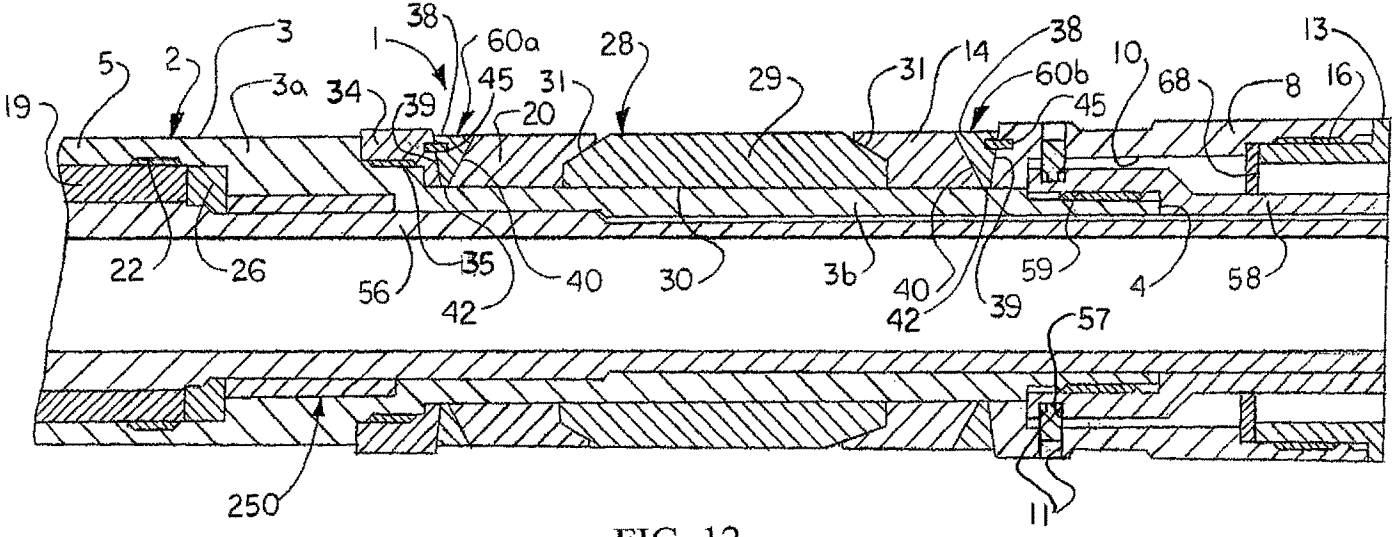
FIG. 12 is a longitudinal sectional view of the illustrative downhole bridge plug or packer assembly illustrated in FIG. 11, deployed in place on a tubing string and shown in a retracted configuration.

As particularly illustrated in FIGS. 4, 6, 7 and 8, in some embodiments, at least one pin opening 44 may extend into the outer ring surface 39 of the backup ring body 37. In some embodiments, a pair of spaced-apart pin openings 44 may extend into the outer ring surface 39. The pin openings 44 may be disposed at about 120 degrees relative to each other around the circumference of the backup ring body 37. As illustrated in FIG. 12, a shear-able ring retainer pin 45 may be seated in each pin opening 44 and in a corresponding registering pin opening (not numbered) in the corresponding adjacent mandrel cap 8 or gauge ring 34. The ring retainer pins 45 may normally retain the upper backup ring 60*a* and the lower backup ring 60*b* in the pre-expanded position during installation of the assembly 1 in the well casing 52 and prior to expansion of the assembly 1.

As illustrated in FIGS. 4 and 8, in some embodiments, at least one fluid emission channel 46 may extend into the engaging ring surface 38 of the backup ring body 37. The fluid emission channel 46 may traverse the width of the backup ring body 37. The fluid emission channel 46 may facilitate emission of fluids from the backup ring body 37 upon expansion of the assembly 1.

Figure 9:
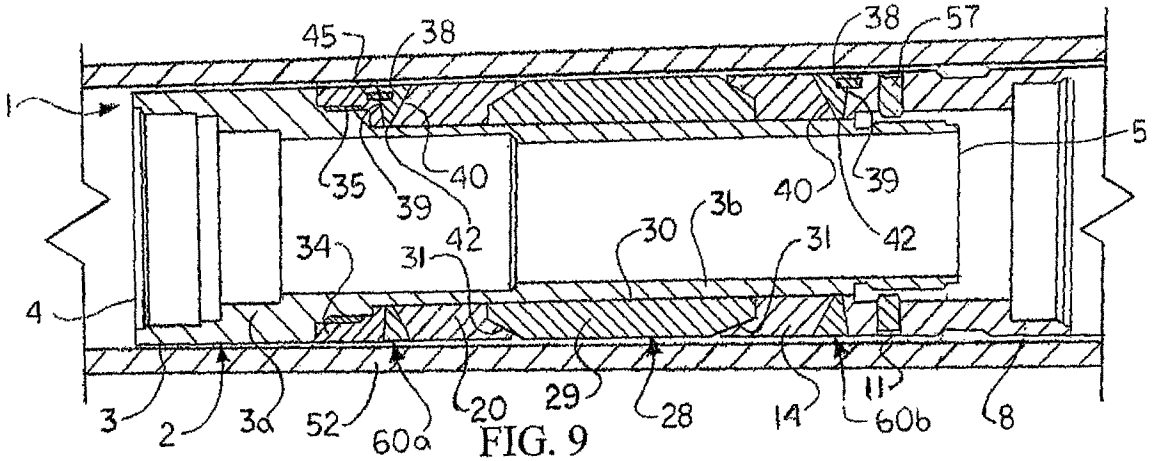
FIG. 9 is a longitudinal sectional view of an illustrative downhole bridge plug or packer assembly deployed in a tubing string with the assembly shown in a retracted configuration disengaging the tubing string.
Figure 10:
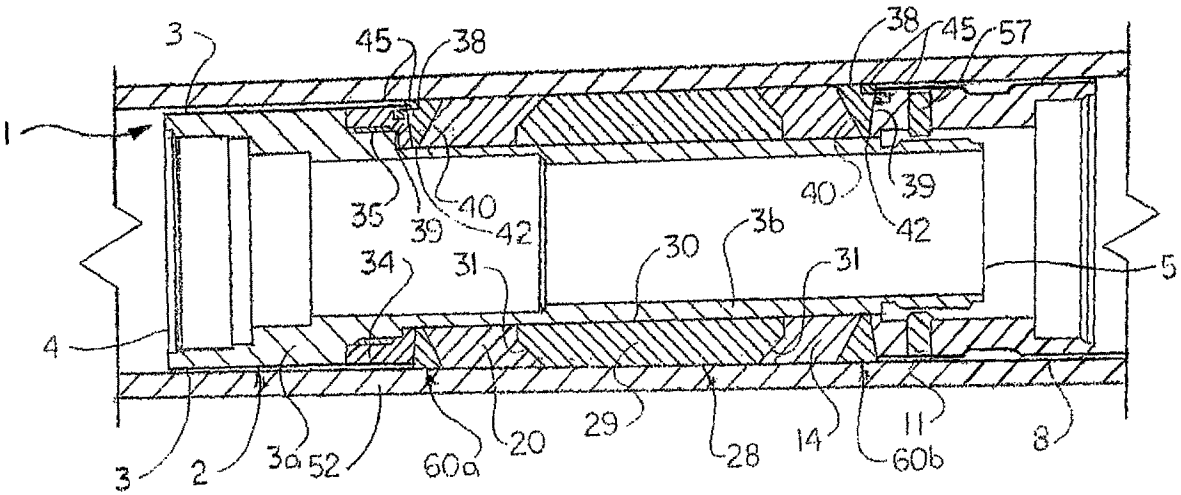
FIG. 10 is a longitudinal sectional view of the illustrative downhole bridge plug or packer assembly deployed in the tubing string with the assembly shown in a circumferentially-expanded configuration engaging the tubing string.
Figure 11:
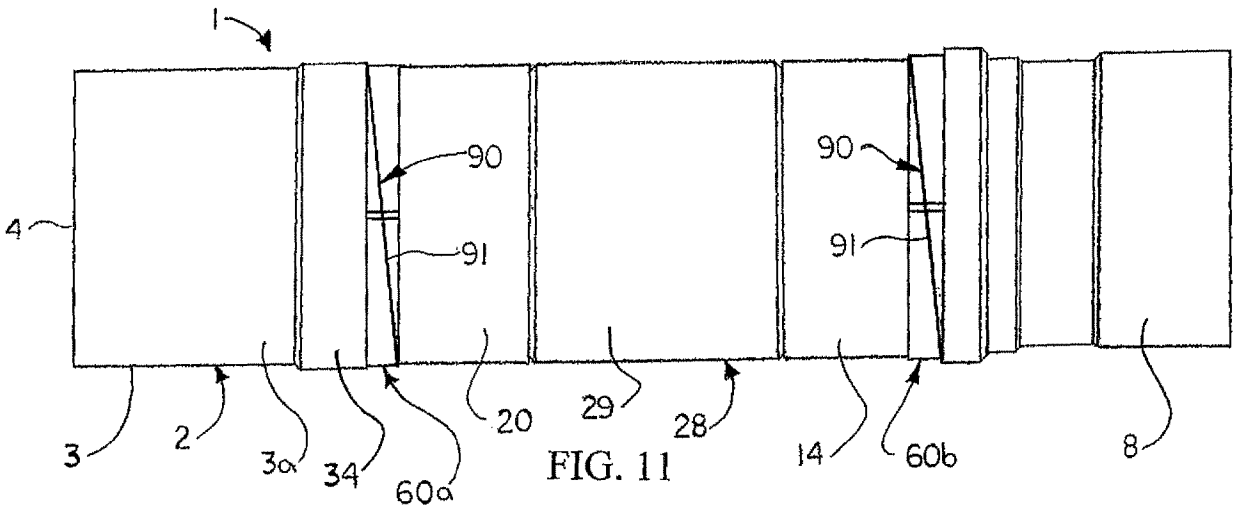
FIG. 11 is a side view of an alternative illustrative downhole bridge plug or packer assembly.

The sealing element 28 of the assembly 1 may include rubber or other elastomeric material. As illustrated in FIGS. 9 and 10, in some embodiments, the sealing element 28 may include a generally cylindrical sealing element wall 29 having an inside sealing element interior surface 30. An exterior annular wall bevel 31 may be provided in each end of the sealing element 28.

The assembly 1 may be assembled on the tubing string 56 as follows. As illustrated in FIG. 12, the gauge ring 34 may be placed on the mandrel shaft 3*b* in engagement with the mandrel head 3*a* of the mandrel 2. In some embodiments, the gauge ring 34 may be threaded on the mandrel head 3*a* via the gauge ring threads 35. The upper backup ring 60*a* may be placed on the mandrel shaft 3*b* with the outer ring surface 39 of the upper backup ring 60*a* engaging the gauge ring 34. The upper backup ring 60*a* may be pinned to the gauge ring 34 via the ring retainer pin or pins 45. The upper spacer ring 20 may be placed on the mandrel shaft 3*b* in engagement with the inner ring surface 40 of the upper backup ring 60*a*.

The sealing element 28 may next be deployed on the mandrel shaft 3*b* with the wall bevel 31 on the corresponding upper end of the sealing element 28 engaging the upper spacer ring 20. The lower spacer ring 14 may then be placed on the mandrel shaft 3*b* in engagement with the wall bevel 31 on the corresponding lower end of the sealing element 28. The lower backup ring 60*b* may be placed on the mandrel shaft 3*b* with the inner ring surface 40 on the lower backup ring 60*b* engaging the lower spacer ring 14. The mandrel cap 8 may receive the mandrel upper end 4 of the mandrel 2 and placed in engagement with the outer ring surface 39 of the lower backup ring 60*b*. The lower backup ring 60*b* may be pinned to the mandrel cap 8 via the ring retainer pin or pins 45.

Figure 13:
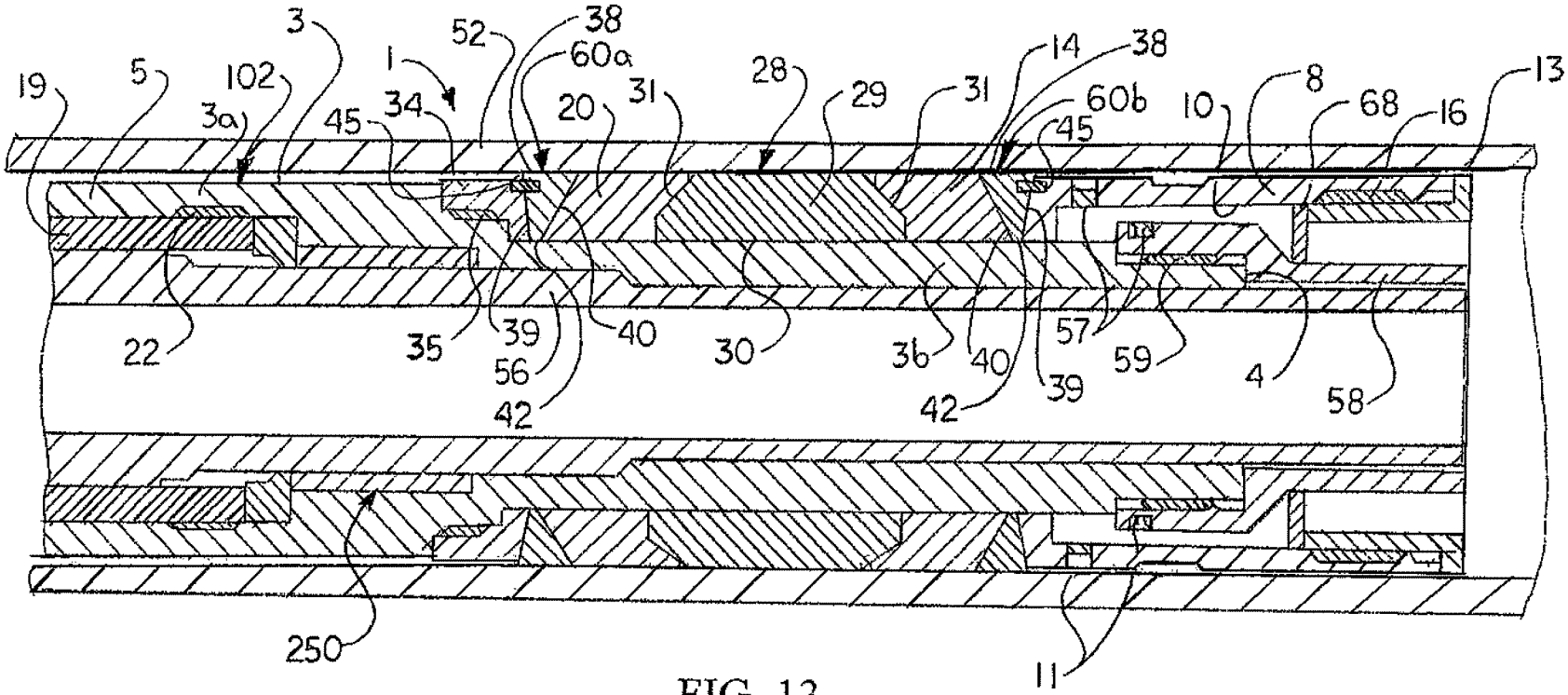
FIG. 13 is a longitudinal sectional view of the illustrative downhole bridge plug or packer assembly illustrated in FIG. 11, deployed in place on a tubing string in a well casing and shown in a circumferentially-expanded configuration engaging the well casing.
Figure 14:
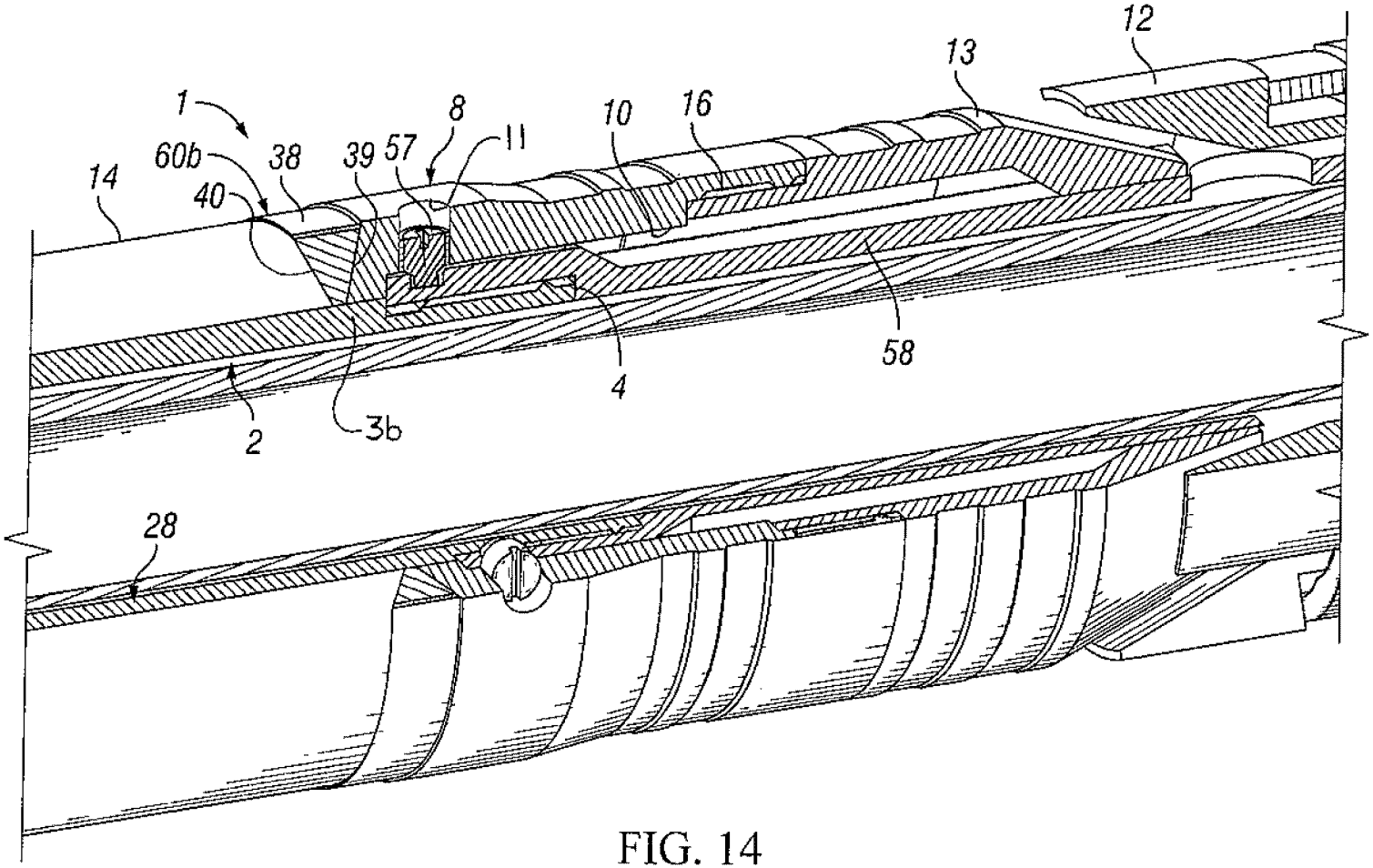
FIG. 14 is a longitudinal sectional perspective view of the illustrative downhole bridge plug or packer assembly.

The assembled assembly 1 may be placed on the tubing string 56. As further illustrated in FIG. 12, a tubing sleeve 58 may be provided on the tubing string 56 and may receive the mandrel upper end 4 of the mandrel shaft 3*b* of the mandrel 2. The tubing sleeve 58 may be attached to the mandrel shaft 3*b* of the mandrel 2 via tubing sleeve threads 59. The tubing sleeve 58 may be slidably disposed within an annular sleeve slide space 10 between the mandrel cap 8 and the mandrel shaft 3*b* of the mandrel 2. The tubing sleeve 58 may be immobilized in the sleeve slide space 10 with a frangible connection which enables the tubing sleeve 58 to become uncoupled from the mandrel cap 8 responsive to a predetermined magnitude of pressure applied to the mandrel cap 8 and/or the tubing sleeve 58. Accordingly, as illustrated in FIGS. 12-14, in some embodiments, at least one shearable tubing string shear pin 57 may be seated in registering shear pin openings 11 in the mandrel cap 8 and the tubing sleeve 58, respectively. Thus, upon pressurization of the assembly 1, which will be hereinafter further described, the tubing string shear pin or pins 57 may be sheared and the mandrel shaft 3*b* and the tubing sleeve 58 may slide in the sleeve slide space 10 from the pre-expanded position illustrated in FIG. 12 to the circumferentially-expanded position of the assembly 1 illustrated in FIG. 13, causing the sealing element 28, the upper spacer ring 20, the lower spacer ring 14, the upper backup ring 60*a* and the lower backup ring 60*b* to circumferentially expand against the well casing 52. In other embodiments, alternative techniques known by those skilled in the art may be used to immobilize the tubing sleeve 58 relative to the mandrel cap 8.

As further illustrated in FIG. 12, the lower cone assembly 13 may be placed on the tubing sleeve 58 in engagement with the mandrel cap 8. The lower cone assembly 13 may be coupled to the mandrel cap 8 via assembly threads 16. An O-ring 68 may terminate the lower cone assembly 13. The O-ring 68 may receive the tubing sleeve 58 and impart a fluid-tight seal between the tubing sleeve 58 and the mandrel cap 8. The lower slip assembly 12 (FIG. 1) may be placed on the tubing string 56 in engagement with the lower cone assembly 13 typically in the conventional manner.

As further illustrated in FIG. 12, a mandrel seal stack 250 may be provided between the interior surface of the mandrel head 3*a* of the mandrel 2 and the exterior surface of the tubing string 56. The mandrel seal stack 250 may have a design which will be hereinafter described.

The upper cone assembly 19 may be provided on the tubing string 56 in engagement with the mandrel head 3*a* of the mandrel 2. As illustrated in FIG. 12, the upper cone assembly 19 may be coupled to the mandrel head 3*a* of the mandrel 2 via upper cone assembly threads 22. In some embodiments, a seal retaining ring 26 may be provided on the tubing string 56 in engagement with the mandrel seal stack 250. The upper slip assembly 18 (FIG. 1) may be provided on the tubing string 56 in engagement with the upper cone assembly 19 typically in the conventional manner. The hydraulic setting tool 24 may be provided on the tubing string 56 adjacent to the upper slip assembly 18. The hydraulic setting tool 24 may engage the upper slip assembly 18 via a threaded, pinned and/or other suitable attachment technique known by those skilled in the art.

Figure 15:
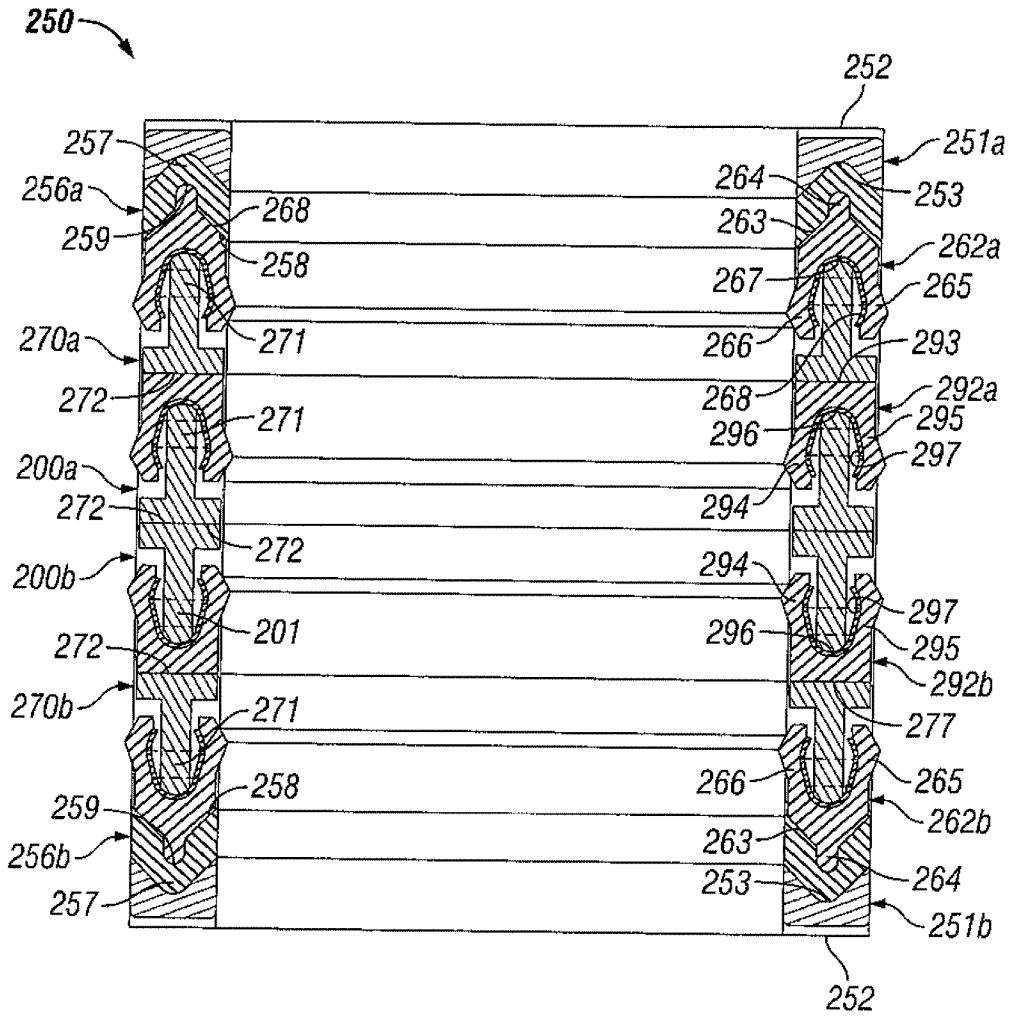
FIG. 15 is a sectional view of a typical mandrel seal pack which is suitable for implementation of the illustrative downhole bridge plug or packer assembly.

An exemplary mandrel seal stack 250 which is suitable for the assembly 1 is illustrated in FIG. 15. The mandrel seal stack 250 may include a pair of outer backup seals 251*a*, 251*b* at opposite ends of the mandrel seal pack 250. Each outer backup seal 251*a*, 251*b* may have a generally flat or planar, annular outer seal surface 252 and an annular inner seal groove 253 which may have a generally V-shaped cross-section. In some embodiments, each outer backup seal 251*a*, 251*b* may include corrosion-resistant steel, for example and without limitation.

Outer V-packing seals 256*a*, 256*b* may seat against the respective outer backup seals 251*a*, 251*b*. Each outer V-packing seal 256*a*, 256*b* may include an annular outer seal lip 257 which inserts in the companion seal groove 253 of the corresponding outer backup seal 251*a*, 251*b*. Each outer V-packing seal 256*a*, 256*b* may also include a pair of concave, angled or tapered inner seal surfaces 258 and an annular seal groove 259 which is at the inner terminus of the inner seal surfaces 258 and may have a generally U-shaped cross-section. In some embodiments, each V-packing seal 256*a*, 256*b* may include virgin PEEK (polyether ether ketone), for example and without limitation.

Jacket seals 262*a*, 262*b* may seat against the respective outer V-packing seals 256*a*, 256*b*. Each jacket seal 262*a*, 262*b* may include a pair of convex tapered outer jacket seal surfaces 263 which engage the respective inner seal surfaces 258 of the corresponding V-packing seal 256*a*, 256*b*. An annular jacket seal lip 264 may extend from the outer jacket seal surfaces 263 and inserts in the companion inner seal groove 259 of the corresponding outer V-packing seal 256*a*, 256*b*. Each jacket seal 262*a*, 262*b* may further include an annular outer jacket seal wall 265, an annular inner jacket seal wall 266 and an annular seal groove 267 which is between the outer jacket seal wall 265 and the inner jacket seal wall 266 and may have a generally U-shaped cross-section. A seal groove spring 268 may line the interior surface of the seal groove 267. In some embodiments, each jacket seal 262*a*, 262*b* may include PTFE (polytetrafluoroethylene), for example and without limitation. Each seal groove spring 268 may include nickel-cobalt alloy, for example and without limitation.

Seal rings 270*a*, 270*b* may seat against the respective jacket seals 262*a*, 262*b*. Each seal ring 270*a*, 270*b* may include an annular ring seal lip 271 which inserts into the companion seal groove 267 of the corresponding jacket seal 262*a*, 262*b* and an annular inner seal surface 272 which may be generally flat or planar. In some embodiments, each seal ring 270*a*, 270*b* may include corrosion-resistant steel, for example and without limitation.

Innermost jacket seals 292*a*, 292*b* may seat against the respective seal rings 270*a*, 270*b*. Each innermost jacket seal 292*a*, 292*b* may have a generally flat or planar, annular outer seal surface 293 which engages the inner seal surface 272 of the corresponding seal ring 270*a*, 270*b*. Each innermost jacket seal 292*a*, 292*b* may further include an annular inner seal wall 294, an annular outer seal wall 295 and an annular seal groove 296 between the inner seal wall 294 and the outer seal wall 295. An annular seal groove spring 297 may line the interior surface of the seal groove 296. In some embodiments, each innermost jacket seal 292*a*, 292*b* may include PTFE (polytetrafluoroethylene), for example and without limitation. Each seal groove spring 297 may include nickel-cobalt alloy, for example and without limitation.

Innermost seal rings 200*a*, 200*b* may seat against the respective innermost jacket seals 292*a*, 292*b*. Each innermost seal ring 200*a*, 200*b* may have a construction and composition which are the same as or similar to those of the seal rings 270*a*, 270*b*, where like reference numerals designate like elements. The ring seal lip 271 of each seal ring 200*a*, 200*b* may insert into the companion seal groove 296 of the corresponding innermost jacket seal 292*a*, 292*b*. The inner ring surface 272 of each innermost seal ring 200*a*, 200*b* may engage the inner ring surface 272 of the adjacent innermost seal ring 200*a*, 200*b*.

As illustrated in FIGS. 12 and 13, in typical application, the apparatus 1 may be placed in a well casing 52 (FIG. 13) which extends into a subterranean fluid-producing well (not illustrated) such as an oil and/or gas well, for example and without limitation, between two adjacent production fractions in the well to seal the fractions from each other and prevent flow of fluid between the fractions. Accordingly, the assembly 1, the upper slip assembly 18, the upper cone assembly 19, the lower slip assembly 12 and the lower cone assembly 13 may be assembled on the tubing string 56 and the hydraulic setting tool 24 may be attached to the tubing string 56 such as in the manner which was heretofore described with respect to FIGS. 1 and 12. The tubing string 56 may then be inserted in the well casing 52. In some applications, the well casing 52 may be oriented in a vertical position in the well in which case the lower slip assembly 12 and the lower cone assembly 13 may be positioned beneath the upper slip assembly 18 and the upper cone assembly 19. In other applications, the well casing 52 may be oriented in a horizontal or diagonal position.

The hydraulic setting tool 24 may next be operated to pull the mandrel 2 and the mandrel cap 8 against the lower slip assembly 12. This action pushes the lower slip assembly 12 onto the lower cone 13. Simultaneously, the hydraulic setting tool 24 may push the upper slip assembly 18 onto the upper cone 19. Therefore, the lower cone 13 pushes or expands the lower slip assembly 12 outwardly until the lower slip assembly 12 engages the interior surface of the well casing 52. In like manner, the upper cone 19 pushes or expands the upper slip assembly 18 outwardly until the upper slip assembly 18 engages the interior surface of the well casing 52. The lower cone 13 travels along the tubing sleeve 58 against the mandrel cap 8 until the tubing string shear pins 57 shear, as illustrated in FIG. 13, and the mandrel cap 8 applies pressure against the lower backup ring 60*b*. Simultaneously, the upper cone assembly 19 travels along the tubing string 56 and pushes against the mandrel head 3*a* of the mandrel 2, which applies the gauge ring 34 against the upper backup ring 60*a*. As further illustrated in FIG. 13, the mandrel shaft 3*b* of the mandrel 2 slides to the right in the sleeve slide space 10. This action compresses the sealing element 28, the lower spacer ring 14, the upper spacer ring 20, the lower backup ring 60*b* and the upper backup ring 60*a* between the lower cone assembly 13 and the upper cone assembly 19. Consequently, the sealing element 28 circumferentially expands and engages the interior surface of the well casing 52 and forms a fluid-tight seal between the assembly 1 and the well casing 52. The upper backup ring 60*a* and the lower backup ring 60*b* expand circumferentially outwardly, shearing the ring retainer pins 45, as illustrated in FIG. 13, and engage the interior surface of the well casing 52, reinforcing and preventing movement of the sealing element 28 as pressure is subsequently placed on the assembly 1 during well operations.

It will be appreciated by those skilled in the art that as the inner ring surface 40 of each of the upper backup ring 60*a* and the lower backup ring 60*b* is pressed against the beveled surface of the upper sealing element 20 and the lower sealing element 14, respectively, the expandable outer ring portion 37*b* (FIGS. 4-9) expands away from the inner ring portion 37*a* of each backup ring 60 along the spiraled ring groove 90. Therefore, the engaging ring surface 38 of each backup ring 60 forms a tight and congruent fit against the interior surface of the well casing 52 and tightly engages the interior surface of the well casing 52, reinforcing and preventing inadvertent movement of the sealing element 28 upon application of pressures to the assembly 1 during well operations. Accordingly, the assembly 1 seals the production fractions from each other through the well casing 52 and operations can be carried out in the well without the leakage of fluid among the separated fractions between the assembly 1 and the well casing 138. When removal of the assembly 1 from the well casing 52 is desired, a drill bit or milling cutter (not illustrated) may be inserted through the well casing 52 and operated to grind the assembly 1 into fragments according to the knowledge of those skilled in the art.

Figure 22:
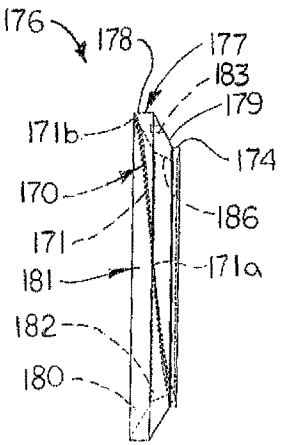
FIG. 22 is a side view of the inner backup ring portion illustrated in FIG. 20.
Figure 25:
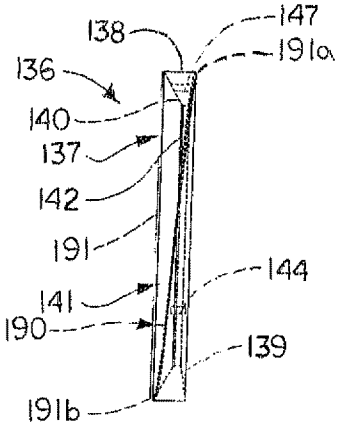
FIG. 25 is a side view of the outer backup ring portion illustrated in FIG. 23.
Figure 24:
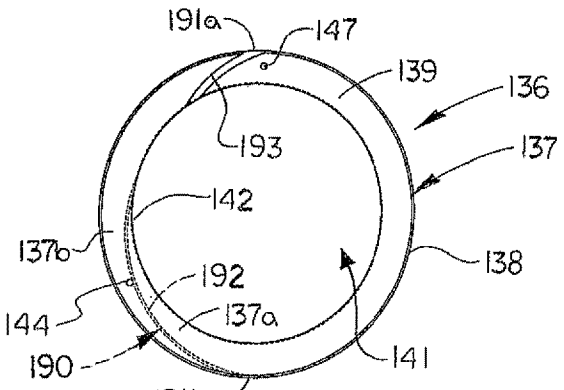
FIG. 24 is an outer view of the outer backup ring portion illustrated in FIG. 23.
Figure 23:
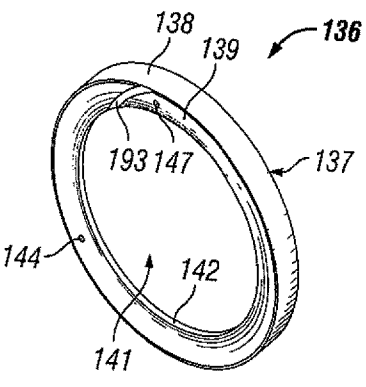
FIG. 23 is an outer perspective view of a typical outer backup ring portion of the backup ring illustrated in FIG. 17.

Referring next to FIGS. 16-26 of the drawings, another illustrative embodiment of the downhole bridge plug or packer assemblies is generally indicated by reference numeral 101. In the assembly 101, elements which are analogous to the respective elements of the assembly 1 that was heretofore described with respect to FIGS. 1-15 are designated by the same numeral in the 101-199 series in FIGS. 16-26. As illustrated in FIGS. 17-26, each of the upper backup ring 160*a* and the lower backup ring 160*b* (illustrated as backup ring 160) may include an outer backup ring portion 136 and an adjacent inner backup ring portion 176. As illustrated in FIGS. 23-25, the outer backup ring portion 136 of each backup ring 160 may have a design which is the same as or substantially the same as that of the backup ring 60 which was heretofore described with respect to FIGS. 4-8, where elements in the 101-199 series in the outer backup ring portion 136 correspond to like elements in the 1-99 series in the backup ring 60.

Figure 26:
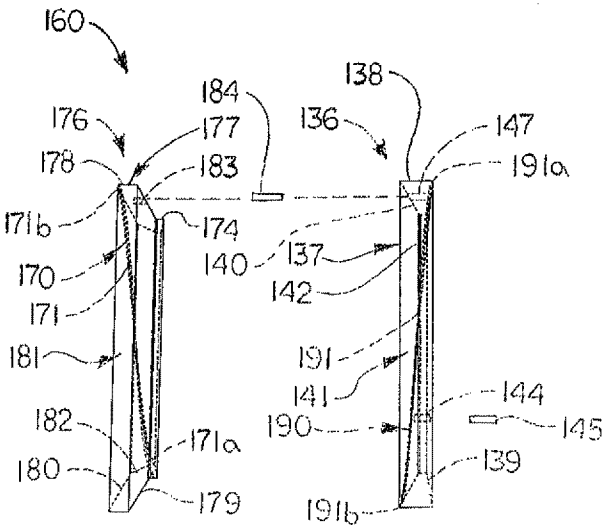
FIG. 26 is an exploded side view of the inner backup ring portion and the outer backup ring portion in typical assembly of the backup ring illustrated in FIG. 17.

As illustrated in FIGS. 25 and 26, a retainer pin opening 144 may extend into the outer ring surface 139 of the outer backup ring portion body 137. As illustrated in FIG. 26, a ring retainer pin 145 may be inserted into the retainer pin opening 144 and into a registering pin opening (not numbered) in the corresponding adjacent gauge ring 134 or mandrel cap 8 (FIG. 16) to couple the upper backup ring 160*a* to the gauge ring 134 and the lower backup ring 160*b* to the mandrel cap 108, respectively. As illustrated in FIGS. 24 and 25, a coupling retainer pin opening 147 may extend through the outer backup ring portion body 137 from the outer ring surface 139 to the inner ring surface 140. As illustrated in FIG. 24, the coupling retainer pin opening 147 may be disposed generally at or near the junction where the outer surface groove segment 193 of the spiraled ring groove 190 meets the engaging ring surface 138 of the outer backup ring portion body 137. As illustrated in FIG. 26, a coupling retainer pin 184 may extend through the coupling retainer pin opening 147 and into a registering coupling retainer pin opening 183 in the inner backup ring portion 176 to couple the outer backup ring portion 136 to the inner backup ring portion 176. The coupling retainer pin 184 may further extend into a registering pin opening (not numbered) in the corresponding gauge ring 134 and mandrel cap 8 to further couple the upper backup ring 160*a* to the gauge ring 134 and the lower backup ring 160*b* to the mandrel cap 108 (FIG. 16), respectively. In some embodiments, the retainer pin opening 144 may be oriented about 120 degrees around the circumference of the outer backup ring portion body 137 from the coupling retainer pin opening 147.

Figure 16:
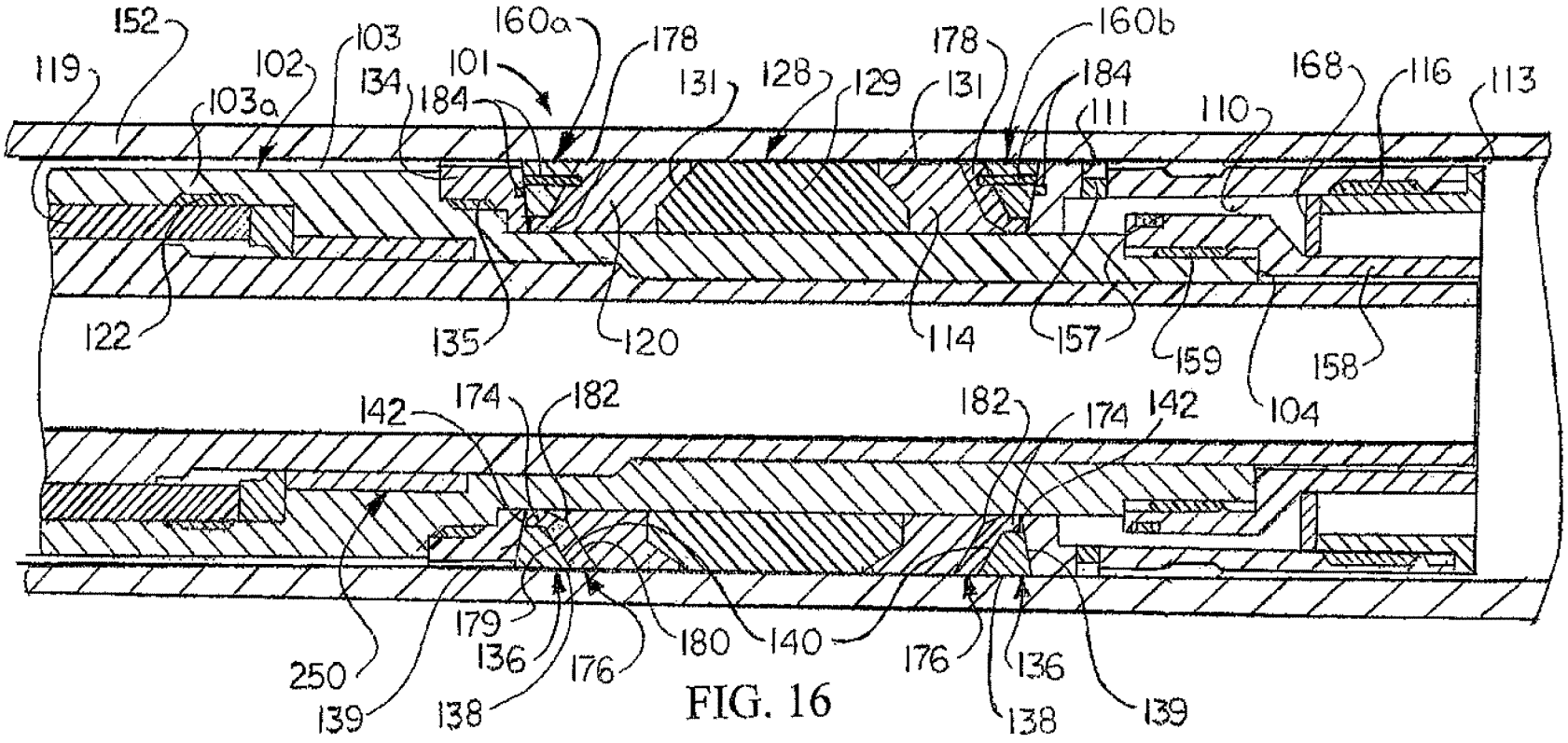
FIG. 16 is a longitudinal sectional view of an alternative illustrative embodiment of the downhole bridge plug or packer assemblies, deployed in place on a tubing string in a well casing and shown in a circumferentially-expanded configuration engaging the well casing.
Figure 19:
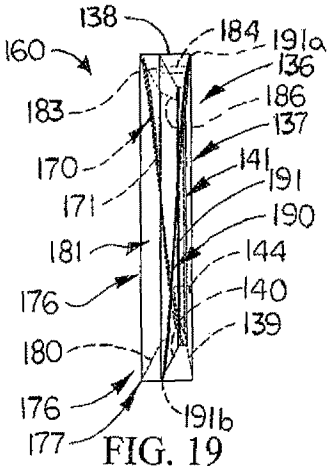
FIG. 19 is a side view of the backup ring illustrated in FIG. 17.

As illustrated in FIGS. 20-22B, the inner backup ring portion 176 of each backup ring 160 may include an annular inner backup ring portion body 177 which may include rubber and/or other elastomeric material. In some embodiments, the inner backup ring portion body 177 may have a continuous unitary or one-piece construction and may include PEEK (polyether ether ketone), for example and without limitation. A ring opening 181 that registers with the ring opening 141 of the outer backup ring portion 136 extends through the inner backup ring portion body 177. As particularly illustrated in FIG. 22, the inner backup ring portion body 177 may have an annular exterior engaging ring surface 178 and an annular interior ring opening edge 182 which faces the ring opening 181. A beveled inner ring surface 180 may extend or taper from the exterior engaging ring surface 178 to the ring opening edge 182 in the ring opening 181. A beveled annular outer ring surface 179 may extend or taper from the engaging ring surface 178. An annular ring lip 174 may protrude from the outer ring surface 179. A beveled annular ring opening surface 186 may extend from the ring opening edge 182 to the ring lip 174 and faces the ring opening 181. As illustrated in FIG. 16, in the assembled assembly 101, the outer ring surface 179 of the inner backup ring portion 176 faces outwardly and is engaged by the inner ring surface 140 of the outer backup ring portion 136, whereas the inner ring surface 140 of the inner backup ring portion 176 faces inwardly and engages the corresponding upper spacer ring 120 or lower spacer ring 114.

A single spiraled ring groove 170 extends along the inner backup ring portion body 177 of the inner backup ring portion 176. The spiraled ring groove 170 may include a main groove segment 171 which extends along the engaging ring surface 178, an inner surface groove segment 172 which extends from the main groove segment 171 along the inner ring surface 180, an interior groove segment 175 which extends from the inner surface groove segment 172 along the ring opening surface 186 and an outer surface groove segment 173 which extends along the outer ring surface 179 from the interior groove segment 175 back to the main groove segment 171.

Figure 22B:
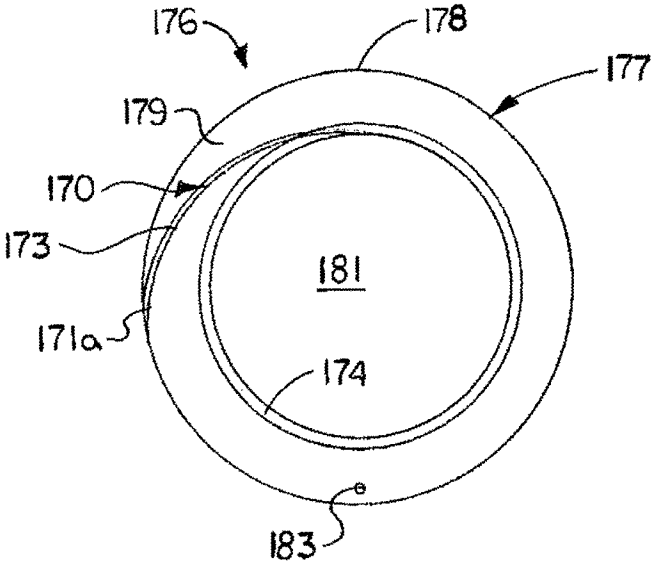
FIG. 22B is an outer view of the inner backup ring portion.
Figure 22A:
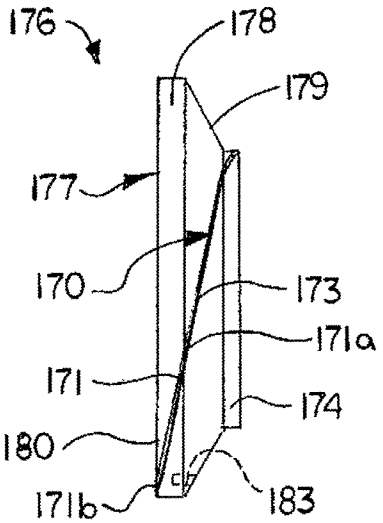
FIG. 22A is a side view of the inner backup ring portion illustrated in FIG. 22, with the inner backup ring portion rotated 180 degrees.

As illustrated in FIG. 22A, the main groove segment 171 of the spiraled ring groove 170 may be generally straight or axial and extends along a portion of the circumference of the engaging ring surface 178. As illustrated in FIGS. 22 and 22A, the main groove segment 171 may have an outer main groove segment end 171*a* at the outer ring surface 179 and an inner main groove segment end 171*b* at the inner ring surface 180.

Figure 21:
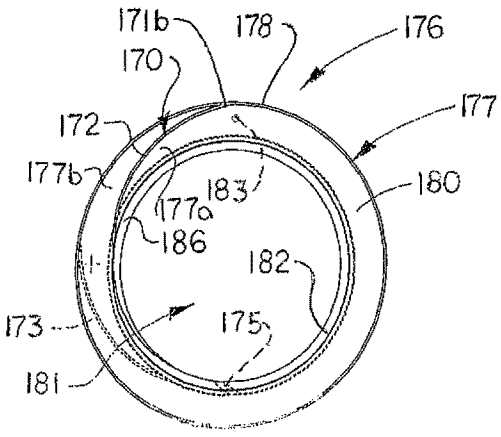
FIG. 21 is an inner view of the inner backup ring portion illustrated in FIG. 20.
Figure 17:
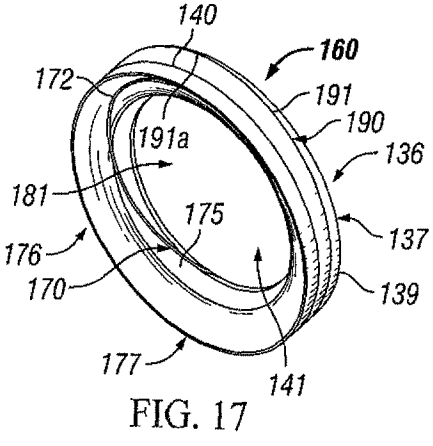
FIG. 17 is an inside perspective view of a typical backup ring of the illustrative downhole bridge plug or packer assembly illustrated in FIG. 16.
Figure 20:
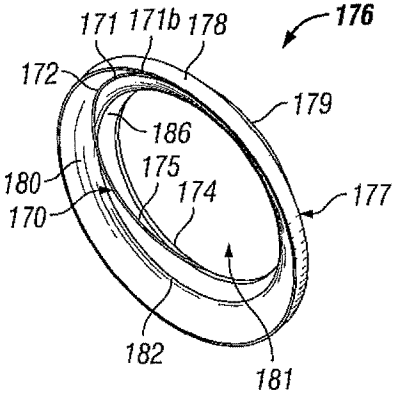
FIG. 20 is an inner perspective view of a typical inner backup ring portion of the backup ring illustrated in FIG. 17.

As illustrated in FIGS. 20 and 21, the inner surface groove segment 172 of the spiraled ring groove 170 may be generally curved and extends from the inner main groove segment end 171*b* of the main groove segment 171 along a portion of the inner ring surface 180 to the ring opening surface 186. As particularly illustrated in FIG. 21, the inner surface groove segment 172 may be generally tangential with respect to both the engaging ring surface 178 and the ring opening edge 182.

As illustrated in FIGS. 22A and 22B, the outer surface groove segment 173 of the spiraled ring groove 170 may be generally curved and extends from the outer main groove segment end 171*a* of the main groove segment 171 along a portion of the outer ring surface 179 and may terminate at the ring lip 174.

Figure 18:
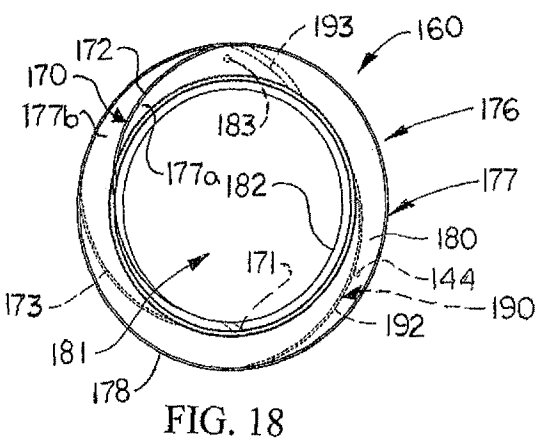
FIG. 18 is an inside view of the backup ring illustrated in FIG. 17.

As illustrated in FIG. 20, the interior groove segment 175 of the spiraled ring groove 170 may extend along the ring opening surface 186 from the inner surface groove segment 172 in the inner ring surface 180 to the outer surface groove segment 173 (FIGS. 22A and 22B) at the ring lip 174. The main groove segment 171, the inner surface groove segment 172, the outer surface groove segment 173 and the interior groove segment 175 of the spiraled ring groove 170 may traverse about 180 degrees of the circumference of the inner backup ring portion body 177. Accordingly, as illustrated in FIG. 18, the spiraled ring groove 170 divides a portion of the inner backup ring portion body 177 into an inner ring portion 177*a* and an expandable outer ring portion 177*b*. Therefore, application of outwardly-directed pressure to the backup ring body 177 facilitates uniform outward circumferential expansion of the expandable outer ring portion 177*b* from the inner ring portion 177*a* against the well casing 152 (FIG. 16) to seal adjacent fractions from each other, as was heretofore described.

As illustrated in FIGS. 21 and 22, the coupling retainer pin opening 183 may extend into the beveled outer ring surface 179 of the inner backup ring portion body 177. As illustrated in FIG. 21, the coupling retainer pin opening 183 may be disposed generally at or near the junction where the inner surface groove segment 172 of the spiraled ring groove 170 meets the engaging ring surface 178 of the inner backup ring portion body 177.

As illustrated in FIG. 26, each backup ring 160 may be assembled by initially orienting the outer backup ring portion 136 and the inner backup ring portion 176 such that the outer ring surface 179 on the inner backup ring portion 176 faces the inner ring surface 140 on the outer backup ring portion 136. The outer backup ring portion 136 or the inner backup ring portion 176 is rotated until the outer coupling retainer pin opening 147 in the outer backup ring portion 136 aligns or registers with the companion inner coupling retainer pin opening 183 in the inner backup ring portion 176. The ring lip 174 on the outer backup ring portion 176 is inserted through the ring opening 141 of the outer backup ring portion 136 as the beveled outer ring surface 179 on the inner backup ring portion 176 engages the companion beveled inner ring surface 140 on the outer backup ring portion 136. Accordingly, as illustrated in FIG. 18, the spiraled ring groove 170 in the inner backup ring portion 176 traverses approximately a first half of the backup ring 160, whereas the spiraled ring groove 190 in the outer backup ring portion 136 traverses approximately a second half of the backup ring 160. The coupling retainer pin 184 maintains the outer backup ring portion 136 in position relative to the inner backup ring portion 176.

Application of the assembly 101 may be as was heretofore described with respect to application of the assembly 1 in FIGS. 12 and 13. As illustrated in FIG. 26, the ring retainer pin 145 may extend into the retainer pin opening 144 in the outer ring surface 139 of the outer backup ring portion 136 and into a registering pin opening (not numbered) in the corresponding gauge ring 134 and mandrel cap 108 (FIG. 16) to couple the upper backup ring 160*a* to the gauge ring 134 and the lower backup ring 160*b* to the mandrel cap 108, respectively. Accordingly, the ring retainer pin 145 may prevent premature outward circumferential expansion of the upper backup ring 160*a* and the lower backup ring 160*b* during deployment of the assembly 101 in the well casing 152. In some applications, the coupling retainer pins 184 may also extend into registering pin openings (not illustrated) in the corresponding adjacent mandrel cap 8 and gauge ring 134 to further retain the upper backup ring 160*a* and the lower backup ring 160*b* in the pre-expanded position during installation of the assembly 101 in the well casing 152 and prior to expansion of the assembly 101. Actuation of the hydraulic setting tool 24 (FIG. 1) compresses the sealing element 128, the lower spacer ring 114, the upper spacer ring 120, the lower backup ring 160*b* and the upper backup ring 160*a* between the lower cone assembly 13 and the upper cone assembly 19 (FIG. 1). Consequently, the sealing element 128 circumferentially expands and engages the interior surface of the well casing 152 and forms a fluid-tight seal between the assembly 101 and the well casing 152 to seal and isolate adjacent hydrocarbon-producing fractions in the well form each other. The upper backup ring 160*a* and the lower backup ring 160*b* expand circumferentially outwardly, shearing the ring retainer pins 145 and coupling retainer pins 184 (FIG. 26), and engage the interior surface of the well casing 152, reinforcing and preventing movement of the sealing element 128 as pressure is subsequently placed on the assembly 101 during well operations.

While illustrative embodiments of the disclosure have been described above, it will be recognized and understood that various modifications can be made and the appended claims are intended to cover all such modifications which may fall within the spirit and scope of the disclosure.

What is claimed is:

1. A bridge plug or packer assembly for a tubing string, comprising:
- a mandrel;
- at least one sealing element provided on the mandrel;
- a pair of backup rings provided on the mandrel on respective sides of the at least one sealing element, each of the pair of backup rings including:
  - an annular backup ring body having:
    - a ring opening receiving the mandrel;
    - a ring opening edge encircling and facing the ring opening;
    - an engaging ring surface;
    - an outer ring surface extending from the engaging ring surface to the ring opening edge;
    - an inner ring surface extending from the engaging ring surface to the ring opening edge opposite the outer ring surface; and
  - a single spiraled ring groove in the backup ring body, the spiraled ring groove having:
    - a main groove segment in the engaging ring surface, the main groove segment extending about 180 degrees around a circumference of the backup ring body;
    - an inner surface groove segment extending from the main groove segment along a portion of the inner ring surface; and
    - an outer surface groove segment extending from the main groove segment along a portion of the outer ring surface;
- a gauge ring provided on the mandrel and engaging a first one of the pair of backup rings;
- a mandrel cap provided on the mandrel and engaging a second one of the pair of backup rings;
- a first shear-able ring retainer pin coupling the backup ring body of the first one of the pair of backup rings to the gauge ring; and
- a second shear-able ring retainer pin coupling the backup ring body of the second one of the pair of backup rings to the mandrel cap.

2. The bridge plug or packer assembly of claim 1 wherein each of the outer ring surface and the inner ring surface is beveled.

3. The bridge plug or packer assembly of claim 2 wherein the outer ring surface is oriented at an outer surface taper angle and the inner ring surface is oriented at an inner surface taper angle with respect to a plane of the backup ring body, and the outer surface taper angle is less than the inner surface taper angle.

4. The bridge plug or packer assembly of claim 3 wherein the outer surface taper angle is about 10 degrees and the inner surface taper angle is about 30 degrees.

5. The bridge plug or packer assembly of claim 1 further comprising at least one fluid emission channel in the engaging ring surface of the backup ring body.

6. The bridge plug or packer assembly of claim 1 wherein the main groove segment of the spiraled ring groove comprises an outer main groove segment end at the outer ring surface and an inner main groove segment end at the inner ring surface.

7. The bridge plug or packer assembly of claim 6 wherein the inner surface groove segment communicates with the inner main groove segment end of the main groove segment at the engaging ring surface.

8. The bridge plug or packer assembly of claim 6 wherein the outer surface groove segment communicates with the outer main groove segment end of the main groove segment at the engaging ring surface.

9. A bridge plug or packer assembly for a tubing string, comprising:
- a mandrel;
- at least one sealing element provided on the mandrel;
- a pair of backup rings provided on the mandrel on respective sides of the at least one sealing element, each of the pair of backup rings including:
  - an annular backup ring body having:
    - a ring opening receiving the mandrel;
    - a ring opening edge encircling and facing the ring opening;
    - an engaging ring surface;
    - an outer ring surface extending from the engaging ring surface to the ring opening edge;
    - an inner ring surface extending from the engaging ring surface to the ring opening edge opposite the outer ring surface; and
  - a single spiraled ring groove in the backup ring body, the spiraled ring groove having:
    - a main groove segment in the engaging ring surface, the main groove segment extending about 180 degrees around a circumference of the backup ring body;
    - an inner surface groove segment extending from the main groove segment along a portion of the inner ring surface; and
    - an outer surface groove segment extending from the main groove segment along a portion of the outer ring surface; and
    - the spiraled ring groove divides a portion of the backup ring body into an inner ring portion and an expandable outer ring portion;
- a gauge ring provided on the mandrel and engaging a first one of the pair of backup rings;
- a mandrel cap provided on the mandrel and engaging a second one of the pair of backup rings;

a first shear-able ring retainer pin coupling the backup ring body of the first one of the pair of backup rings to the gauge ring; and a second shear-able ring retainer pin coupling the backup ring body of the second one of the pair of backup rings to the mandrel cap.

10. The bridge plug or packer assembly of claim 9 wherein each of the outer ring surface and the inner ring surface is beveled.

11. The bridge plug or packer assembly of claim 10 wherein the outer ring surface is oriented at an outer surface taper angle and the inner ring surface is oriented at an inner surface taper angle with respect to a plane of the backup ring body, and the outer surface taper angle is less than the inner surface taper angle.

12. The bridge plug or packer assembly of claim 11 wherein the outer surface taper angle is about 10 degrees and the inner surface taper angle is about 30 degrees.

13. The bridge plug or packer assembly of claim 9 further comprising at least one fluid emission channel in the engaging ring surface of the backup ring body.

14. The bridge plug or packer assembly of claim 9 wherein the main groove segment of the spiraled ring groove comprises an outer main groove segment end at the outer ring surface and an inner main groove segment end at the inner ring surface.

15. The bridge plug or packer assembly of claim 14 wherein the inner surface groove segment communicates with the inner main groove segment end of the main groove segment at the engaging ring surface.

16. The bridge plug or packer assembly of claim 14 wherein the outer surface groove segment communicates with the outer main groove segment end of the main groove segment at the engaging ring surface.

17. A bridge plug or packer assembly for a tubing string, comprising:

a mandrel;

at least one sealing element provided on the mandrel;

a pair of backup rings provided on the mandrel on respective sides of the at least one sealing element, each of the pair of backup rings including:

an outer backup ring portion having:

an annular outer backup ring portion body;

a ring opening in the outer backup ring portion body, the ring opening in the outer backup ring portion body receiving the mandrel;

a ring opening edge in the outer backup ring portion body, the ring opening edge encircling and facing the ring opening in the outer backup ring portion body;

an engaging ring surface in the outer backup ring portion body;

an outer ring surface extending from the engaging ring surface to the ring opening edge in the outer backup ring portion body;

an inner ring surface extending from the engaging ring surface to the ring opening edge in the outer backup ring portion body opposite the outer ring surface; and a single spiraled ring groove in the outer backup ring portion body, the spiraled ring groove in the outer backup ring portion body having:

a main groove segment in the engaging ring surface in the outer backup ring portion body;

an inner surface groove segment extending from the main groove segment along a portion of the inner ring surface of the outer backup ring portion body; and an outer surface groove segment extending from the main groove segment along a portion of the outer ring surface of the outer backup ring portion body;

an inner backup ring portion coupled to the outer backup ring portion, the inner backup ring portion having:

an annular inner backup ring portion body;

a ring opening in the inner backup ring portion body, the ring opening in the inner backup ring portion body receiving the mandrel;

an engaging ring surface in the inner backup ring portion body;

a ring opening surface in the inner backup ring portion body;

an outer ring surface extending from the engaging ring surface to the ring opening surface in the inner backup ring portion body;

an inner ring surface extending from the engaging ring surface to the ring opening surface in the inner backup ring portion body opposite the outer ring surface of the inner backup ring portion body; and a single spiraled ring groove in the inner backup ring portion body, the spiraled ring groove in the inner backup ring portion body having:

a main groove segment in the engaging ring surface of the inner backup ring portion body;

an inner surface groove segment extending from the main groove segment along a portion of the inner ring surface of the inner backup ring portion body;

an outer surface groove segment extending from the main groove segment along a portion of the outer ring surface of the inner backup ring portion body; and an interior groove segment extending from the inner surface groove segment along the ring opening surface of the inner backup ring portion body and to the outer surface groove segment of the inner backup ring portion body;

a gauge ring provided on the mandrel and engaging the outer backup ring portion of a first one of the pair of backup rings;

a mandrel cap provided on the mandrel and engaging the outer backup ring portion of a second one of the pair of backup rings;

a first shear-able ring retainer pin coupling the outer portion backup ring body of the first one of the pair of backup rings to the gauge ring; and a second shear-able ring retainer pin coupling the outer portion backup ring body of the second one of the pair of backup rings to the mandrel cap.

18. The bridge plug or packer assembly of claim 17 further comprising at least one coupling retainer pin coupling the outer backup ring portion body of the outer backup ring portion to the inner backup ring portion body of the inner backup ring portion of each of the pair of backup rings.

19. The bridge plug or packer assembly of claim 18 wherein the at least one coupling retainer pin further couples each of the pair of backup rings to a corresponding one of the gauge ring and the mandrel cap.

20. The bridge plug or packer assembly of claim 17 wherein the spiraled ring groove in the inner backup ring portion traverses approximately a first half of each of the pair of backup rings and the spiraled ring groove in the outer backup ring portion traverses approximately a second half of each of the pair of backup rings.

* * * * *